US005369835A

United States Patent [19]

Clarke

[11] Patent Number: 5,369,835

[45] Date of Patent: Dec. 6, 1994

[54] TOOTHBRUSH ASSEMBLY

[75] Inventor: A. R. Hyde Clarke, Old Greenwich, Conn.

[73] Assignee: Delphic Inc, Springfield Ctr., N.Y.

[21] Appl. No.: 98,098

[22] Filed: Jul. 28, 1993

[51] Int. Cl.[5] ..... A46B 3/00; A46B 17/04; A46B 17/02

[52] U.S. Cl. ..... 15/167.1; 15/172; 15/176.1; 15/184; 132/311; 248/110

[58] Field of Search ..... 15/167.1, 143.1, 145, 15/146, 176.1, 176.6, 184, 172; 248/110; 211/66; 206/361; 132/311

[56] References Cited

U.S. PATENT DOCUMENTS

| | | | |
|---|---|---|---|
| 174,832 | 3/1876 | McChesney | 15/184 |
| 1,054,017 | 2/1913 | Miller | 132/311 |
| 1,432,717 | 10/1922 | Miller | 15/184 |
| 1,847,253 | 3/1932 | Munro | 248/110 |
| 2,092,212 | 9/1937 | Horton et al. | 15/184 |
| 2,294,631 | 9/1942 | Rocca | 15/184 |
| 2,416,684 | 3/1947 | Fischer | 15/167.1 |
| 2,441,051 | 5/1948 | Wilhelm | 248/110 |
| 2,921,326 | 1/1960 | Lautmann | 15/167.1 |
| 3,794,181 | 2/1974 | Canham | 248/110 |
| 4,592,109 | 6/1986 | Borea et al. | 15/145 |
| 4,811,445 | 3/1989 | Lagieski et al. | 15/176.6 |
| 4,979,708 | 12/1990 | Aoki | 248/110 |

FOREIGN PATENT DOCUMENTS

| | | | |
|---|---|---|---|
| 451964 | 8/1913 | France | 15/184 |
| 638860 | 6/1928 | France | 15/184 |
| 94355 | 6/1969 | France | 15/105 |
| 403709 | 6/1966 | Switzerland | 15/176.1 |
| 13490 | of 1885 | United Kingdom | 15/184 |
| 07114 | 5/1991 | WIPO | 15/167.1 |

*Primary Examiner*—Stephen F. Gerrity
*Assistant Examiner*—Tony G. Soohoo
*Attorney, Agent, or Firm*—Michael Ebert

[57] ABSTRACT

A toothbrush assembly having a handle component and a brush component which in the storage mode of the assembly is housed within the handle component. In the brushing mode, the brush component is attached to the handle component and projects therefrom. The brush component is formed by a shank having a brush head anchored thereon, the shank terminating in a mounting plug. The handle component is formed by a hollow body having an elongated belly section in whose cavity the brush component is storable, the belly section flowing into an enlarged annular shoulder leading to a neck section adapted to socket the plug of the brush component. The handle body is contoured to define a concave fore depression at the junction of the shoulder and the neck section, and a concave aft depression at the junction of the shoulder and the belly section. When the belly section is cradled in the palm of the user's hand, the fore and aft depressions as well as the shoulder afford selectable gripping sites for the index finger and thumb to facilitate manipulation of the handle so that the brush head can reach the dental surfaces to be cleaned and can be oriented to apply a brushing pressure thereto in a manner appropriate to the surface engaged thereby.

9 Claims, 4 Drawing Sheets

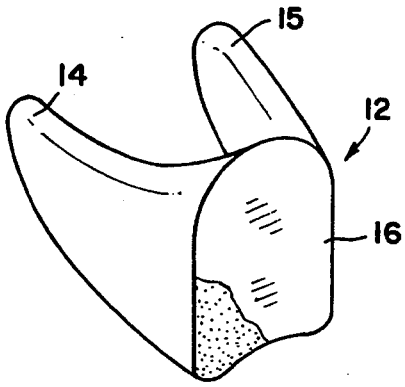
FIG. 2
FIG. 1
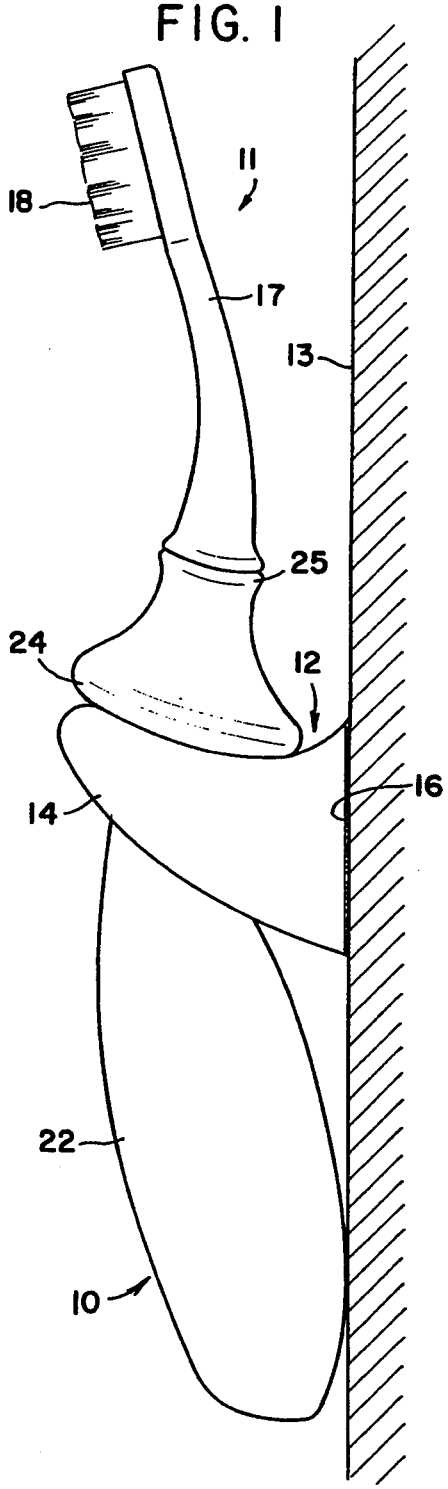
FIG. 3
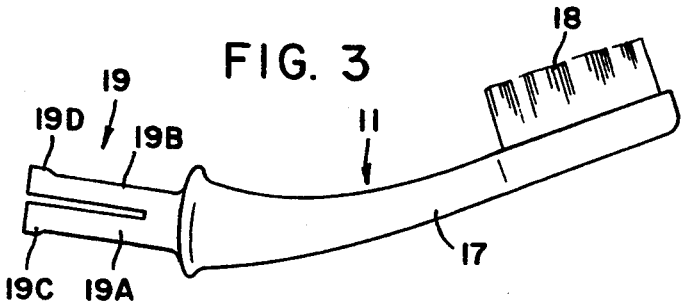
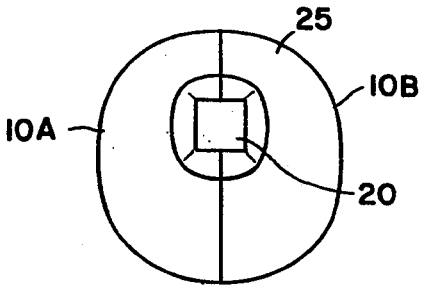
FIG. 4

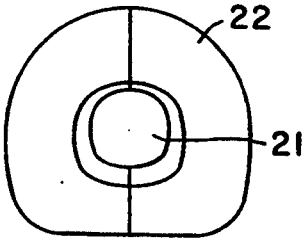
FIG. 5
FIG. 7
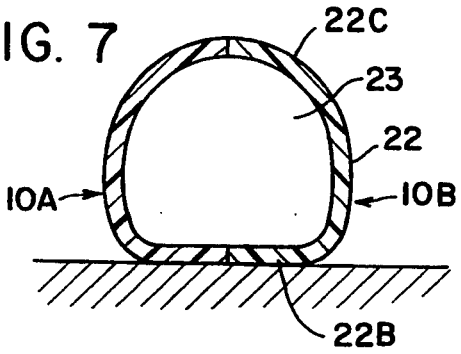
FIG. 8
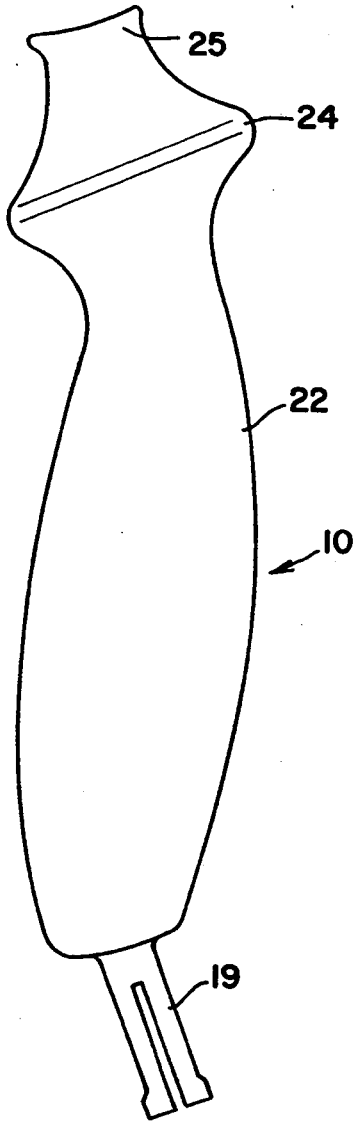
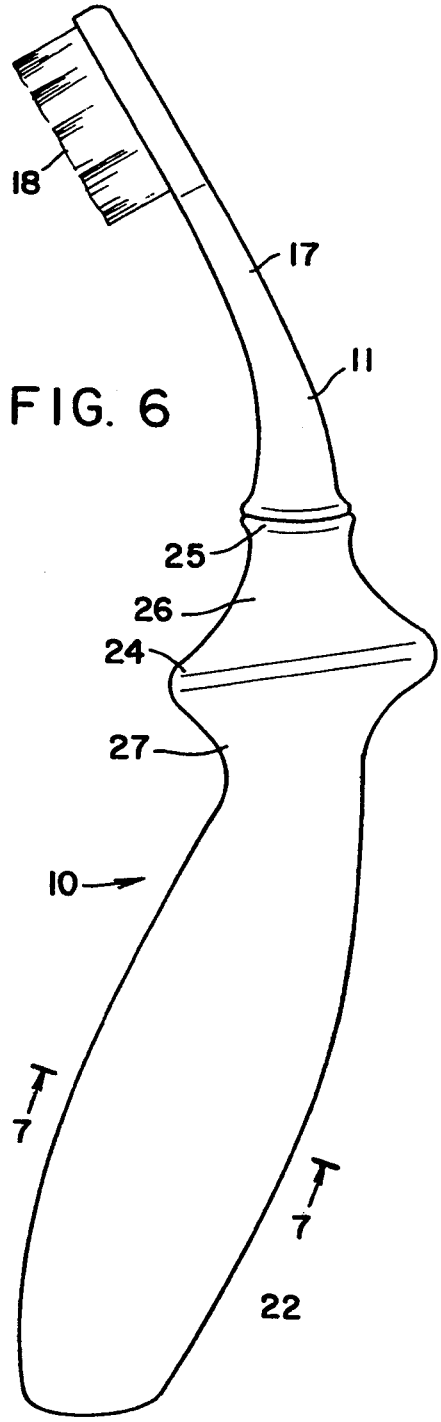
FIG. 6

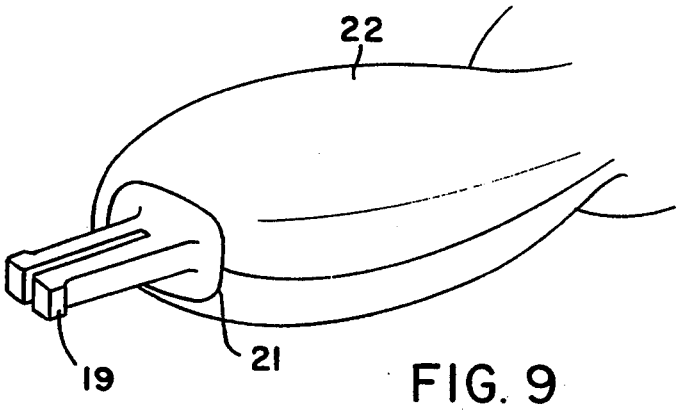
FIG. 9
FIG. 10
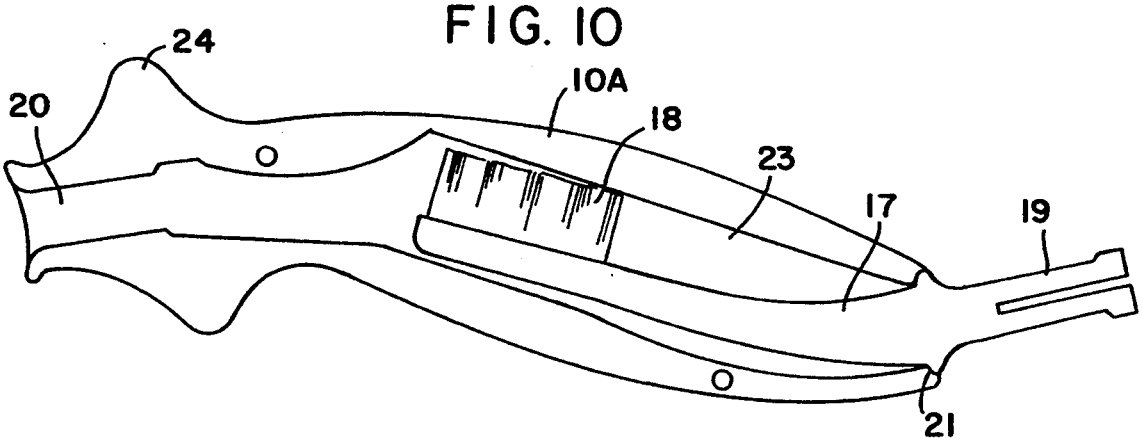
FIG. 11
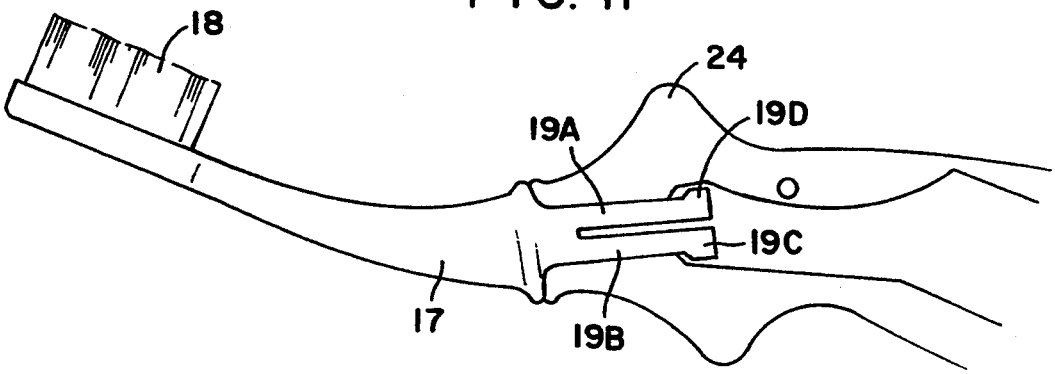

FIG. 12
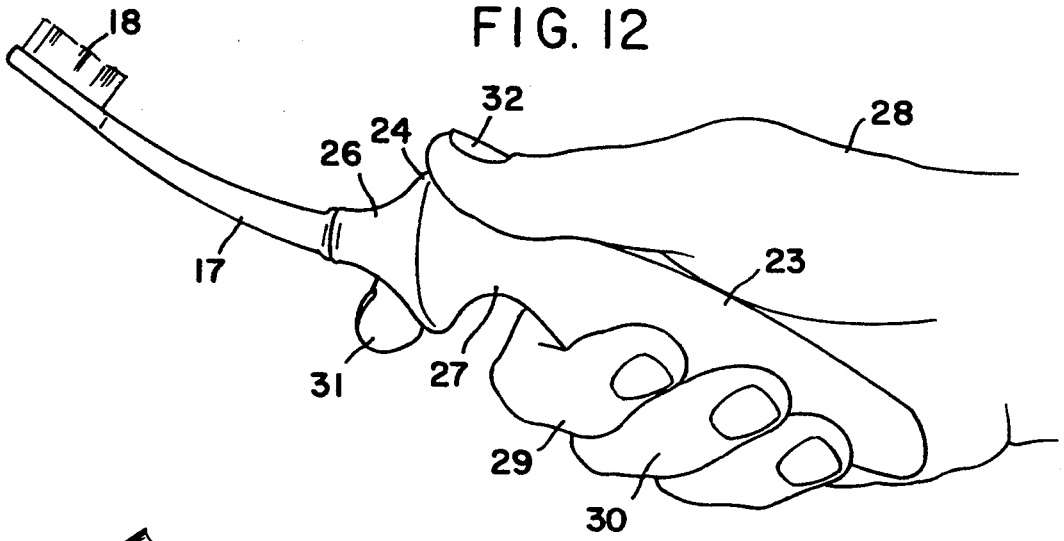
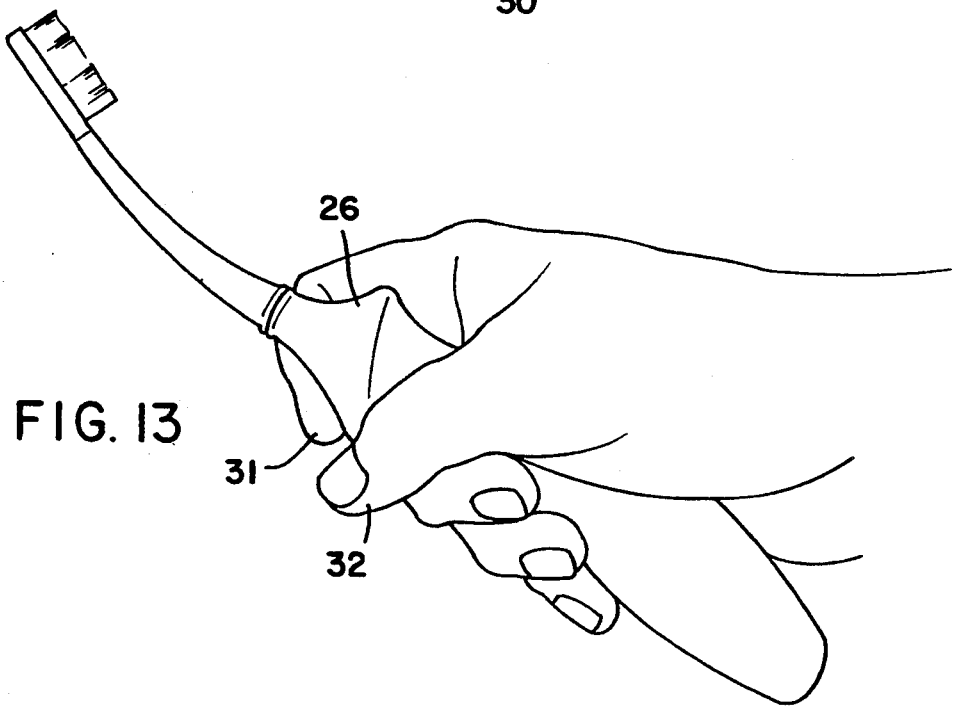
FIG. 13
FIG. 14
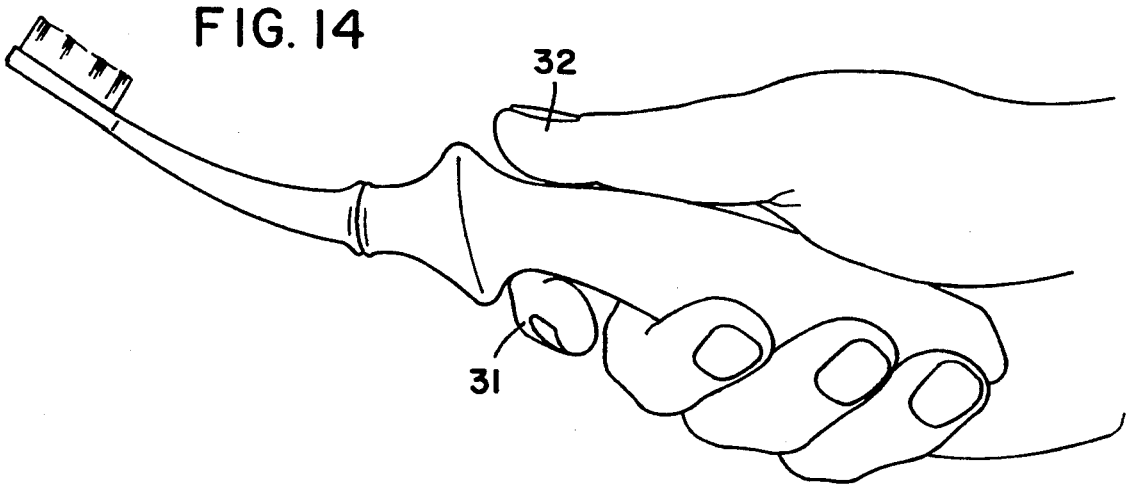

TOOTHBRUSH ASSEMBLY

BACKGROUND OF INVENTION

1. Field of Invention

This invention relates generally to toothbrushes for brushing the teeth and the gingiva below the teeth in the oral cavity, and more particularly to a toothbrush assembly consisting of a handle component and a brush component, the brush component in the storage mode of the assembly being housed within the handle component, and in the brushing mode being attached to the handle component and projecting therefrom.

2. Status of Prior Art

A toothbrush is the basic implement used in dental hygiene. In its standard form, it consists of a molded plastic handle having a shank extension on which a brush head is anchored. This head is created by a cluster of nylon or other bristles, usually in a rectangular array.

The stick-like handle of a conventional toothbrush handle is such that in order to grip it firmly, the fingers of the user's hand are curled about the handle, the thumb being pressed against the inner surface to provide a prehesile grip. No use is made of the palm of the handle when gripping the handle of a conventional toothbrush.

The dental structure in the oral cavity is in a horseshoe formation, the teeth projecting above the gingiva. In effective dental hygiene, food particles and other plaque-producing contaminants which adhere to the inner and outer surfaces of the dental structure or which lodge in the crevices between adjacent teeth must be scrubbed away to arrest the growth on these surfaces of pathogenic organisms. These organisms are the principal etiological factor associated with periodontal disease, dental infections and caries. This is not difficult to do with a conventional toothbrush in the more accessible frontal regions of the dental structure.

However, the stick-like handle of a standard toothbrush militates against a thorough brushing action in the less accessible rear and side regions of the dental structure on both the inner and outer surfaces thereof. These regions are hard to reach without unduly stretching the mouth to permit angling of the toothbrush.

The ability of the user to manipulate a standard toothbrush so that its brush head can reach and engage the relatively inaccessible surfaces of the dental structures to effect a scrubbing action is limited by the geometry of the standard toothbrush. The brush head is in a right angle to a straight line handle stick and therefore cannot be curved in toward the surface to be brushed. And the handle stick lends itself to be gripped by the fingers of the hand in only one way and is therefore inflexible in regard to how the handle can be manipulated to orient the brush head with respect to the surfaces to be brushed.

Another serious drawback of a standard toothbrush is that some users tend to grasp the stick-like handle with excessive force in order to prevent the handle from slipping in the course of brushing activity. When a user so clenches the handle, he also tends to brush the dental surfaces with excessive vigor. Such vigorous activity may in time cause the gums to recede and expose the roots of the teeth with damaging consequences.

With many other users of a standard toothbrush, the problem is not their tendency to grip the toothbrush handle with excessive force, but lies in their inability to effectively grip the handle.

A large number of senior citizens have diminished digital capacity, other users have underdeveloped or impaired muscular strengths or poor coordination, still others suffer from joint diseases which interfere with their ability to clench their fist or to grip a handle effectively.

The prior art recognizes the limitations of conventional toothbrushes and seeks to overcome these limitation in various ways. Thus the Beebe et al. patent 4,283,808 provides a sausage-shaped foam-plastic handle for a toothbrush that is easier to grip then a conventional toothbrush handle. In the toothbrush disclosed in this patent, a plug-in brush component is coupled to the handle.

In the toothbrush shown in the Borea et al. U.S. Pat. No. 4,592,109, the handle is contoured to define mounds and depressions affording an anatomical grip.

The toothbrush shown in the O'Halloran U.S. Pat. No. 4,454,623 includes a handle having a planar finger rest and a concave thumb rest to facilitate manipulation of the handle. The Hanse et al. U.S. Pat. No. 4,780,924 discloses a toothbrush having a replaceable brush head and a handle having an S-shaped indentation to accommodate the thumb and forefinger of the user. In the toothbrush handle shown in the Ernest et al. U.S. Pat. No. 4,589,437, the handle has a front portion that is offset by angled intermediate portion from a rear portion.

While these prior art toothbrushes have advantages over conventional toothbrushes and improve the grip, the finger and thumb positions are confined to predetermined sites and therefore lack flexibility. To make it possible to manipulate the handle so that the brush head can reach all regions of the dental structure and engage the inner and outer surfaces thereof, with the brush head properly oriented to carry out an effective brushing action, one must be able to grasp the handle in a manner appropriate to the surface to be engaged and its location on the dental structure.

SUMMARY OF INVENTION

The main object of the invention is to provide an ergonomic toothbrush assembly that takes into account physical limitations to establish an optimum human engineering relationship between the hand of the user and the toothbrush.

Since particularly, an object of the invention is to provide an assembly consisting of a handle component and a brush component which in the storage mode of the assembly is housed within the handle component, and in the brushing mode projects therefrom.

Also an object of the invention is to provide an assembly of the above type having a contoured handle component whose shape and size are such as to permit the handle to be cradled in the palm of a user's hand while being gripped at selected gripping sites by the thumbs and index finger, thereby making it possible to manipulate the toothbrush in a manner appropriate to the surface of the dental structures to be brushed and its location.

A significant advantage of an assembly in accordance with the invention is that it is useable by individuals having diminished or underdeveloped digital strength, or poor coordination, or who suffer from joint diseases which interfere with their gripping ability.

Yet another object of this invention is to provide a toothbrush assembly in which the brush component is formed by a curved shank having a brush head anchored thereon, the shank plugging into the handle component so that the brush head is curved away from the handle body.

A further object of the invention is to provide a wall bracket for the toothbrush assembly which is adapted to securely support the assembly against a wall, yet permits the ready removal of the assembly from the bracket.

Another advantage of the invention is that it avoids contamination of the brush head, for when the brush component is plugged into the handle component and the toothbrush assembly rest on a counter or other flat surface that may not be clean, the brush head, regardless of how the brush component is plugged into the handle component, is then spaced from the flat surface.

Yet another advantage of the invention is that the brush component of the assembly which has a limited life because of its brush head, is replaceable, whereas the handle component is permanent and has an indefinite life.

Briefly stated, the objects are attained in a toothbrush assembly having a handle component and a brush component which in the storage mode of the assembly is housed within the handle component. In the brushing mode, the brush component is attached to the handle component and projects therefrom. The brush component is formed by a shank having a brush head anchored thereon, the shank terminating in a mounting plug. The handle component is formed by a hollow body having an elongated belly section in whose cavity the brush component is storable, the belly section flowing into an enlarged annular shoulder leading to a neck section adapted to socket the plug of the brush component.

The handle body is contoured to define a concave fore depression at the junction of the shoulder and the neck section, and a concave aft depression at the junction of the shoulder and the body section. When the belly section is cradled in the palm of the user's hand, the fore and aft depressions as well as the shoulder afford selectable gripping sites for the index finger and thumb to facilitate manipulation of the handle so that the brush head can reach the dental surfaces to be cleaned and can be oriented to apply a brushing pressure thereto in a manner appropriate to the surface engaged thereby.

BRIEF DESCRIPTION OF DRAWINGS

For a better understanding of the invention, as well as other objects and features thereof, reference is made to the accompanying of drawings wherein:

FIG. 1 illustrates a toothbrush assembly in accordance with the invention as it appears in its brushing mode, the assembly being mounted on a wall bracket in readiness for use;

FIG. 2 separately shows the bracket;

FIG. 3 illustrates the brush component of the assembly;

FIG. 4 is a front view of the handle component of the assembly;

FIG. 5 is a rear view of the handle component;

FIG. 6 shows the assembly with the brush component plugged into the handle component in a manner which is reverse of that shown in FIG. 1;

FIG. 7 is a transverse section of the handle component taken in the plane indicated by line 7—7 in FIG. 6;

FIG. 8 illustrates the assembly in its storage mode with the brush component housed in the handle component;

FIG. 9 is a rear view of the assembly in its storage mode;

FIG. 10 shows a half section of the handle component which exposes the inner cavity therein in which is stored the brush component;

FIG. 11 shows the same half section of the handle component which exposes the inner socket therein that receives the plug of the brush component;

FIG. 12 illustrates one manner of gripping the handle component to manipulate the assembly;

FIG. 13 illustrates another manner of gripping the assembly; and

FIG. 14 illustrates still another manner.

DETAILED DESCRIPTION OF INVENTION

Structure of Assembly

As shown in FIG. 1, a toothbrush assembly in accordance with the invention consists of a handle component, generally designated by numeral 10, and a brush component, generally designated by numeral 11. In the brushing mode of the assembly, brush component 11 is plugged into the front end of the handle component and projects therefrom, as shown in FIG. 1. The assembly, when in condition for use, is supported on a bracket 12 that is adhered to or otherwise attached to a vertical bathroom wall 13.

As best seen in FIG. 2, bracket 12 which is molded of polypropylene, or other high-strength plastic, is defined by a pair of upwardly-curved tusks 14 and 15 projecting from a base 16 having a flat underside on which provided a layer of pressure-sensitive adhesive so that the bracket may be adhered to the wall at any desired position thereon.

Brush component 11, as shown separately in FIG. 3, is formed of a shank 17 of synthetic plastic material on whose front end is anchored a brush head 18 whose cluster of bristles project laterally from the inner side of the shank. At the rear end of the shank is a bifurcated plug 19 whose flexible tines 19A and 19B terminate in detents 19C and 19D. When plug 19 is received in a socket at the front end of the handle component 10, the detents are then caught in the socket to retain plug 19 therein. Shank 17 is curved so that the brush head 18 at its front end lies on a curve deviating from the longitudinal axis of plug 19 at its rear end.

Handle component 10 which is hollow, is formed by a pair of complementary half sections 10A and 10B. As shown in FIGS. 4 and 5, these sections are joined together to create at the front end of this component a socket 20 to receive the plug 19 of the brush component, and at the rear end to create a cavity inlet 21 to receive the brush component 11 in the storage mode of the assembly.

Socket 20 at the front end of the handle component has a square cross section what matches that of the plug 19 received therein so that the handle component having brush head 18 anchored on curved shank 17 maybe oriented to assume any one of four angular positions which are 90 degrees apart, depending on how the user wishes to manipulate the toothbrush assembly.

The hollow body of the handle component 10, as best seen in FIGS. 6 and 7 includes an elongated belly section 22 having a flat base 22B and an arched wall 22C which together define an internal cavity 23. Belly section 22 flows into an enlarged annular shoulder 24 leading to a neck section 25 adapted to socket the plug 19 of the brush component.

The hollow body of the handle component is contoured to define a concave fore depression 26 at the junction of shoulder 24 and neck 25, and a concave aft depression 27 at the junction of shoulder 24 and belly section 22. These fore and aft depressions 26 and 27 as well as the shoulder 24 afford selectable gripping sites for the index finger and thumb of the user's hand to facilitate manipulation of the handle.

When the assembly is in its storage mode, as shown in FIGS. 8 and 9, the brush component is inserted through internal cavity inlet 21 into the handle component 10 so that the brush component is then housed within the handle component, the plug 19 sticking out of the handle component, so that the user can pull the brush component out of the handle component. The storage mode is used when traveling with the assembly, or when it is to be packaged or stored away.

FIG. 10 shows a half section 10A of the handle component 30 exposing the socket 20 at the front end of this component, the cavity inlet 21 at the rear and leading into the internal cavity 23. FIG. 10 shows the brush component stored in cavity 23, with plug 19 projecting from the rear end.

FIG. 11 shows the same half section, but with the brush component projecting from the handle component, the plug 19 being received in socket 20 and being held therein by the tine detents 19C and 19D.

Manipulation of Assembly

In the brushing mode of the assembly, depending on how the brush component is plugged into the handle component, there are four possible orientations of the brush head 18 with respect to the handle component. FIG. 1 shows one such orientation in which the brush head 18 curves toward the left of shoulder 24, while the belly section 22 of the handle curves toward the right. FIG. 6 shows the reverse orientation, for both brush head 18 and the belly section curve toward the left of shoulder 24.

In the other two possible orientations which are not shown, the brush head is at right angles to that shown in FIG. 1, facing the back or facing the front.

But regardless of the orientation of the brush head, when the toothbrush assembly is placed on a flat counter or other horizontal surface on a sink or elsewhere, then as shown in FIG. 7, it is the flat base 22B of the belly section of the handle component and the shoulder 24 which engage this surface, the geometry of the assembly being such that the brush head 18 is spaced from the surface and is not contaminated thereby.

When as shown in FIGS. 12 to 14, the toothbrush assembly is put to use in its brushing mode, the belly section 23 is then cradled in the palm of the user's hand, the middle finger 29 and fingers 30 and 31 curling about the belly section. Because of this cradling action, even those users who lack physical strength or the ability to completely clench their fingers, can get a good grip on the handle.

The fore and aft concave depressions 26 and 27 and the shoulder 24 constitute selective gripping sites. Hence it becomes possible for a user to grip the handle in various ways and in doing so manipulate the toothbrush so as to reach all surfaces of the dental structure, including those which are relatively inaccessible.

Three different finger gripping patterns are shown in FIGS. 12, 13 and 14, but in each case the handle is cradled in the palm of the hand. In the pattern shown in FIG. 12, index finger 31 is pressed into the fore depression 26 while the thumb 32 engages shoulder 24. In the pattern shown in FIG. 12, the index finger 31 circles about fore depression 26 while the thumb 32 lies within aft depression 27. And in FIG. 14, thumb 32 is pressed into the upper side of aft depression 27 while index finger 31 is pressed into the underside of the aft depression.

By reason of these three gripping sites for the forefinger and the thumb, and the fact that the handle is cradled in the palm of the user's hand whose other fingers curl about the handle, the handle component is accommodated to the physical limitations of the user to establish an optimal human engineering relationship for manipulating the toothbrush assembly.

While there has been shown and described a preferred embodiment of the assembly it will be appreciated that many changes may be made thereon within the spirit of the invention. Thus a handle component in accordance with the invention need not be combined with a dental toothbrush component, for it is also useful with other dental implement, such as dental picks, and with eating and cooking implements as well as a handle for various tools, particularly that whose blades must reach relatively inaccessible sites.

I claim:

1. A toothbrush assembly comprising:

A. a brush component formed by a shank having a brush head anchored on a front end thereof and a plug extending from a rear end thereof; and B. a handle component having a hollow, generally arcuate body provided with a front end square socket to receive the plug of the brush component so that the brush component may be selectively oriented relative to the handle component in any one of four positions displaced ninety degrees from each other, and provided at a rear end with an inlet leading to an internal cavity whereby in a brushing mode of the assembly said brush component plug is plugged into the front end square socket and projects therefrom to assume a position relative to the arcuate body of the handle component in one of said four positions, and whereby in a storage mode, the brush component is inserted through the inlet into the cavity of said handle component, with the plug then projecting outward from the inlet beyond said rear end.

2. A toothbrush assembly as set forth in claim 1, wherein said plug is bifurcated to define a pair of flexible tines terminating in detents which act to hold the plug within the socket.

3. A toothbrush assembly as set forth in claim 1, in which said hollow body is formed of high-strength synthetic material.

4. A toothbrush assembly as set forth in claim 3, in which said body is formed by complementary half sections that are joined together.

5. A toothbrush assembly as set forth in claim 1, wherein said hollow body is formed by an elongated belly section shaped to fit in the palm of a user's hand said belly section being joined at one end to an enlarged annular shoulder whereby said annular shoulder is joined at a junction to a neck section defining said square socket.

6. A toothbrush assembly as set forth in claim 5, in which said hollow body is contoured to define a first concave depression at the junction of the shoulder and the neck section, and second concave depression at the junction of the shoulder and the belly section.

7. A toothbrush assembly as set forth in claim 6, wherein said first and second depressions and said shoulder are shaped to define selective gripping sites for the forefinger and the thumb of the user's hand.

8. A toothbrush assembly as set forth in claim 5, further including a wall-mounting bracket formed by a pair of tusks underlying the annular shoulder of the handle component to support the assembly.

9. A toothbrush assembly as set fourth in claim 8, wherein the bracket has a base provided with a pressure-sensitive adhesive.

* * * * *